US005779128A

United States Patent [19]

Szczerba

[11] Patent Number: 5,779,128

[45] Date of Patent: Jul. 14, 1998

[54] NAIL DRIVING APPARATUS

[76] Inventor: Miroslaw A. Szczerba, 1011 Boren Ave. #213, Seattle, Wash. 98104

[21] Appl. No.: 656,054

[22] Filed: May 31, 1996

[51] Int. Cl.[6] ..... B25C 1/02

[52] U.S. Cl. ..... 227/113; 227/132; 227/146; 227/147

[58] Field of Search ..... 227/113, 119, 227/132, 146, 147, 142

[56] References Cited

U.S. PATENT DOCUMENTS

| | | | |
|---|---|---|---|
| 1,152,260 | 8/1915 | Anderson | 227/147 |
| 2,475,936 | 7/1949 | Allen | 227/147 |
| 2,587,944 | 3/1952 | Williams | 227/147 |
| 2,767,399 | 10/1956 | Widener | 227/146 |
| 4,120,438 | 10/1978 | Litch | 227/147 |
| 4,403,725 | 9/1983 | Lawrence | 227/147 |
| 4,960,235 | 10/1990 | Gregory | 227/147 |
| 5,398,861 | 3/1995 | Green | 227/132 |
| 5,426,858 | 6/1995 | Clark et al. | 30/367 |

*Primary Examiner*—Scott A. Smith
*Attorney, Agent, or Firm*—Kevin S. Costanza

[57] ABSTRACT

A nail driving apparatus comprising a tube, a rod with a mass attached to one end, a spring connecting the mass to the tube, and a sleeve encircling the exposed portion of rod between the tube and the mass. When the mass is in the forward, closed position, the spring is slightly stretched, holding the apparatus in the closed position. When the mass is drawn away from the tube, the spring is displaced, increasing the tension in the spring and, thus, aiding the user in driving a nail. An expandable sleeve protects the exposed portion of rod between the tube and the mass from being contaminated by debris. It also prevents the user's hand from being positioned at the point of contact. As the mass is drawn away from the tube, the sleeve expands to protect the entire length of exposed rod.

21 Claims, 4 Drawing Sheets

SECTION A–A

SECTION B–B

NAIL DRIVING APPARATUS

BACKGROUND OF THE INVENTION

This invention relates generally to a nail driving device. More particularly, it relates to a device for driving nails into surfaces that are inaccessible to the user of a traditional hammer either because an obstacle lies in the path of the hammer or the user, or because the nailing surface is separated from the user by a distance longer than the user's arm.

In carpentry and construction work, an individual often comes across a situation in which driving a nail is made difficult, or impossible, by the existence of one or more obstacles in the path of the hammer, the user, or both. For example, in the case of fabricating plywood forms prior to pouring concrete, this type of situation is almost the norm. After the first side of a form is built and the re-bar is laid in place, nailing something to the inside of the form cannot be accomplished with a traditional hammer because the re-bar obstructs the hammer's path.

To date, in order to drive nails in such a situation, construction workers have used an apparatus known in the industry as a "pea-shooter." A pea-shooter comprises a thin walled aluminum tube approximately two feet in length and one-half inch in diameter, a steel rod approximately the same length as the tube, and a weight attached to the back end of the rod. The weight is drawn away from the tube slightly, creating a hollow portion at the front end of the tube. The front, hollow section is placed over the nail, and the tube butted against the nailing surface. Holding the tube with one hand and the weight with the other, the user drives the nail by repeatedly sliding the rod and weight along the length of the tube.

Numerous disadvantages exist with the traditional pea-shooter. First, because the entire device is collinear with the nail being driven, the impact generated when the end of the rod contacts the nail translates directly through the apparatus to the user's arm. After repeated use of the device for an extended period of time, users have an increased likelihood of suffering arm injuries, such as, long-term tendonitis in the wrist and elbow.

Also, as the weight is drawn away from the tube, the rod is exposed to the surrounding environment. On a typical construction site, this environment can contain a significant amount of, among other things, dirt and sawdust. Any significant amount of contamination between the rod and the tube makes the device less efficient, increasing the amount of force required to drive a nail and, likewise, increasing the risk of impact-related injuries.

Another disadvantage of the existing pea-shooter is that the tube and rod are not connected. Unless the front end of the device remains lower than the back end, the weight pulls the rod out of the tube and the weighted rod falls to the ground. Maintaining the device's orientation is made more difficult by the fact that the weight forces the back end of the device toward the ground. If the user is above ground level, a falling, weighted steel rod can be extremely dangerous. In addition, picking up the rod entails traveling all of the way to the ground level, which can be a considerable waste of time if the user is high off the ground or strapped into a harness.

Because the tube and the rod are not connected, it is also difficult to store the device when it is not being used. If the weight alone is attached to a contractor's belt, the tube can slide off and fall to the ground. If, on the other hand, the tube alone is attached to a belt, the weight will tend to twist the device about the point of attachment. When the weight falls below the point of attachment, the weighted rod will fall to the ground. If the weight doesn't fall below the point of attachment, the device tends to hang at an angle. In this position, the device is burdensome and could possibly cause the user to trip and fall.

Yet another disadvantage of the existing pea-shooter is that, during use, the weight can collide with the back end of the tube with great force. If the user's hand is between the weight and the back end of the tube, the user's hand can be seriously injured upon impact. Even if there is no injury, repeated collisions between the parts can distort the back end of the tube, creating bent, buckled or flared metal that can impede performance or cause injury.

SUMMARY OF THE INVENTION

It is an object of this invention to provide a nail driving apparatus that will allow a user to efficiently drive nails in areas where physical obstructions prohibit the use of a traditional hammer.

It is a further object of the present invention to provide such a hammer designed so that the user is assisted in driving the nail, thus reducing the stress transferred to the user's arm as well as the potential for permanent injury.

It is yet a further object of the present invention to provide such a hammer designed so that the boundary between the rod and the tube is not exposed to the surrounding environment, decreasing the likelihood of contamination impeding the hammer's operation.

It is yet a further object of the present invention to provide such a hammer designed so that all of the parts are connected, preventing the possibility of dropping a part and injuring a person below.

It is yet a further object of the present invention to provide such a hammer designed so that the point of contact between the weight and the tube is encircled by a physical barrier preventing the user's hand from being pinched between the tube and the moving mass.

In order to perform these functions and to overcome the above problems, the invention incorporates a tube, a rod with a solid mass attached to one end, a spring connecting the mass to a point along the length of the tube, and a sleeve encircling the exposed portion of rod between the tube and the mass. When the mass is in the forward, closed position (against the tube), the spring is slightly stretched. This residual displacement of the spring tends to hold the apparatus in the closed position. The tension in the spring also prohibits the rod from accidentally falling out of the tube.

When the mass is drawn away from the tube, the spring is displaced even further. The increased tension in the spring aids the user in driving a nail. This spring-assisted driving force allows the user to exert less force on the apparatus, thus causing less shock on the user's arm and reduced likelihood of trauma. Under most conditions, the user can actually "throw" the mass, eliminating all impact-related stresses.

The expandable sleeve protects the exposed portion of rod between the tube and the mass from being contaminated by debris. It also prevents the user's hand from being positioned at the point of contact. As the mass is drawn away from the tube, the sleeve expands to protect the entire length of the exposed rod.

In the preferred embodiment, the tube is fabricated from thin-walled, one-half inch O.D. aluminum tubing with a circular cross-section. The rod is fabricated from carbon or stainless steel, with an outside diameter selected to leave approximately 1/32" clearance between the outside surface of the rod and the inside surface of the tube. The overall length of the apparatus is approximately two and one-half feet. Other materials with similar properties and other size combinations can be substituted to vary the invention's weight, strength, flexibility or other characteristics.

Other objects and advantages will become apparent when taken into consideration with the following drawings and specifications.

DESCRIPTION OF THE PREFERRED EMBODIMENT

Figure 1:
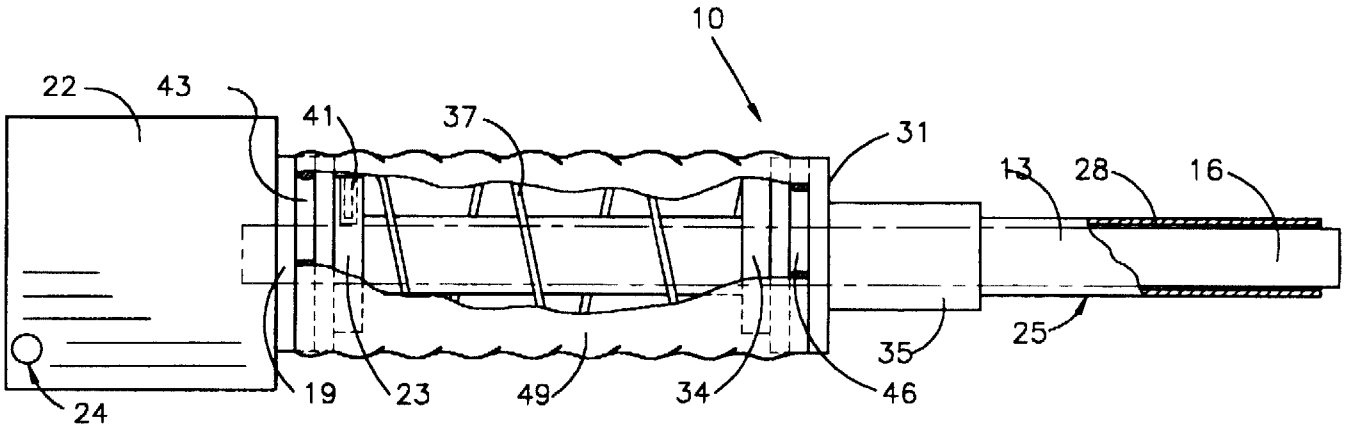
FIG. 1 is a side elevation view of a first embodiment of the present invention, including two cut-away sections.
Figure 2:
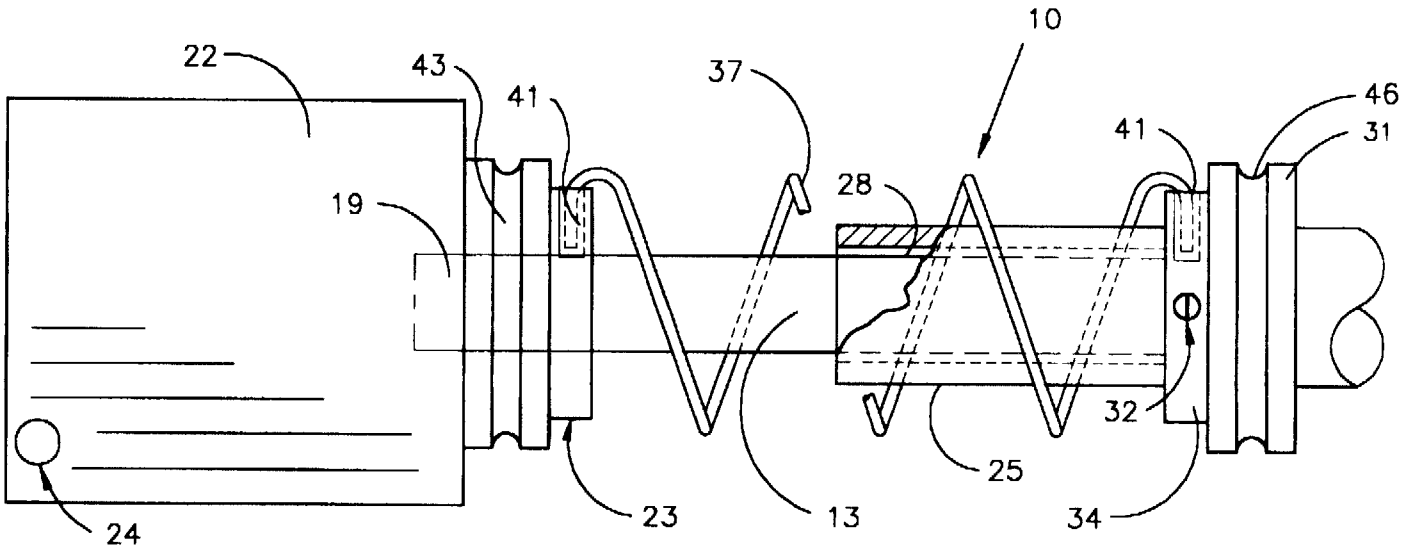
FIG. 2 is side elevation views of the back, weighted end of a first embodiment of the present invention, including a cut-away section.
Figure 3B:
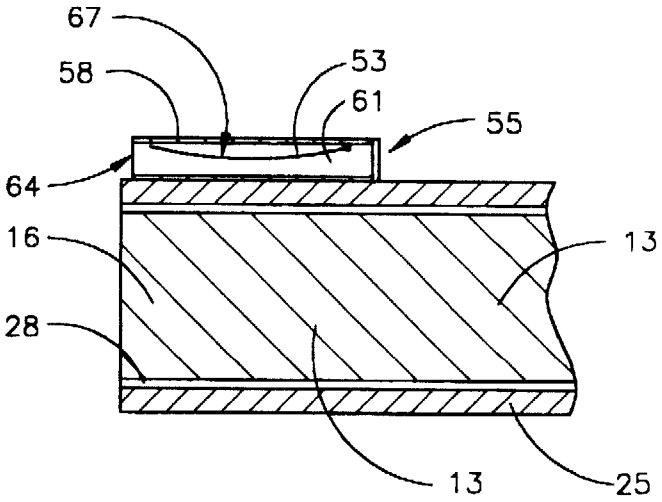
FIGS. 3*a* and 3*b* are an end view and a side elevation view, respectively, of the front end of a first embodiment of the present invention.
Figure 3A:
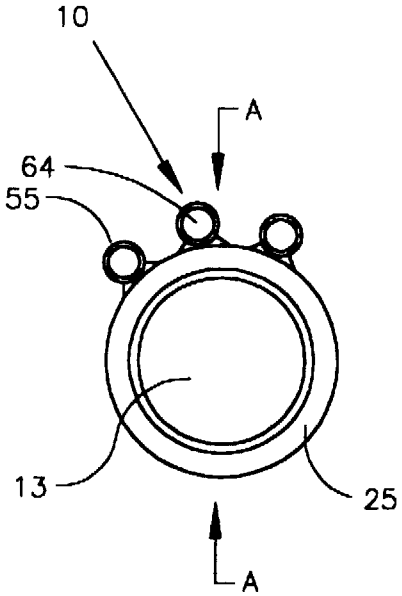

FIGS. 1–3 show a nail driving apparatus 10 according to a preferred embodiment of the present invention. Apparatus 10 comprises a steel rod 13 having a front end 16 and a back end 19. Front end 16 terminates in a substantially flat surface perpendicular to the longitudinal axis of rod 13. In the preferred embodiment, rod 13 is fabricated from either carbon or stainless steel and has a circular cross-section. The terminal point of front end 16 can be hardened by any means known in the industry, or can be coated with a hardened material.

Rod 13 is rigidly attached to a heavy mass 22 at back end 19. Mass 22 can be attached to rod 13 by any known means, and can either be permanently attached (e.g., glued or welded) or removably attached (e.g., tap and died, or slotted with a retaining pin). Mass 22 can be of any shape, preferably cylindrical, and can be contoured to complement the fingers of the user's hand. The outside diameter of mass 22 is approximately two and one-half inches (2½"). Mass 22 can comprise a small aperture 24 through which the user can run a strap or a hook in order to tether apparatus 10.

The external surface of mass 22 can be coated on with a friction enhancing substance (e.g., rubber), or can be machined to enhance the friction between the object and the user's hand (e.g., knurled). The portion of mass 22 that is adjacent to rod 13 is formed into a cylindrical first neck 23 approximately one-half inch (½") in width and two inches in diameter. The axis of rotation of first neck 23 is collinear with the longitudinal axis of rod 13.

Apparatus 10 further comprises a tube 25 having a longitudinal bore 28 with the same cross-sectional shape as rod 13. Rod 13 lies within and is slightly longer than bore 28 such that, when mass 22 is abutted against tube 25, the terminal point of front end 16 extends approximately one-eighth inch (⅛") beyond the terminal point of tube 25. The gap between rod 13 and tube 25 is approximately one-thirty-secondth of an inch (1/32"), allowing rod 13 to move freely along the length of bore 28. Tube 25 is preferably fabricated from one-half inch (½") round, aluminum tubing.

A cylindrical collar 31 is rigidly attached to the outside surface of tube 25 at a point approximately one-quarter of its length as measured from the end closest to mass 22. Collar 31 has an outside diameter of approximately two and one-half inches (2½"), and can be attached to tube 25 using any known fastening means, preferably at least one set screw 32. At the end closest to mass 22, collar 31 comprises a cylindrical second neck 34. Second neck 34 is of substantially the same size and shape as first neck 23. On the side opposite second neck 34, collar 31 comprises an elongated, cylindrical handle 35.

Mass 22 is elastically attached to collar 31 by a spring 37. In the preferred embodiment, spring 37 is helical, concentrically encircling both tube 25 and rod 13. The outer diameters of first neck 23 and second neck 34 are approximately equal to the inner diameter of spring 37, allowing spring 37 to releasably engage mass 22 and collar 31. The ends of spring 37 can be rigidly attached to mass 22 and collar 31 by any known fastening means. In one embodiment, the terminal ends of spring 37 are bent inward toward the apparatus' central axis and held within a first cavity 41 in each of first neck 23 and second neck 34. Any biasing means known in the particular industry can be substituted for spring 37 including, e.g., rubber bands.

First neck 23 has an outer dimension greater than bore 28, preventing mass 22 from penetrating tube 25. Also, when mass 22 is abutted against tube 25, spring 31 is displaced slightly longer than its natural state, creating a residual force that tends to hold mass 22 against tube 25.

The stiffness (spring constant) of spring 37 can be varied to accommodate users with differing needs. Also, for any given spring 37, the default displacement (when mass 22 is abutted against tube 25) can be adjusted by loosening set screw 32 and moving collar 31 along the length of tube 25. Moving collar 31 toward front end 16 will increase the tension in spring 37, and visa versa.

The perimeter of mass 22 adjacent first neck 23 comprises a concave first groove 43 having an arcuate cross section. First groove 43 is approximately three-sixteenth's of an inch (3/16") wide. Collar 31 comprises a similar concave second groove 46 adjacent second neck 34. A flexible first sleeve 49 is attached to apparatus 10, one end engaging first groove 43 and the other end engaging second groove 46. First sleeve 49 encircles spring 37 as well as the portions of tube 25 and rod 13 that lie between mass 22 and collar 31. First sleeve 49 can be rigidly attached at first groove 43 and second groove 46 by any known fastening means. As mass 22 is drawn away from tube 25, first sleeve 49 expands to protect the entire exposed length of rod 13 from exposure to foreign objects. First sleeve 49 also prevents the user's hand from being pinched between mass 22 and tube 25 on impact.

Attached to tube 25 at the end corresponding to front end 16 is at least one nail holder 55. Nail holder 55 comprises a cylindrical body 58 with a longitudinal axis parallel to that of tube 25. Nail holder 55 has a central cavity 61 with a circular cross-section that terminates in a circular aperture 64 directed toward front end 16. A leaf spring 67 is mounted near the end of cavity 61 opposite aperture 64, and is positioned longitudinally along substantially the entire length of cavity 61. Leaf spring 67 is in the form of an arcuate curve, approximately one and one-half inches (1½") in length. The extreme ends of leaf spring 67 are in contact with the wall of cavity 61, and the middle of it approaches the middle of cavity 61.

The inner diameter of cavity 61 is slightly larger than the head of a nail. The length of cavity 61 is approximately one-half inch (½") shorter than a nail. Of the plurality of holders 55, one is designed to hold a "sixteen penny" nail, one is designed to hold an "eight penny" nail, and one a "ten penny" nail. When the head of a nail is forced into aperture 64 and moves along the length of cavity 61, leaf spring 67 is compressed into a substantially flat position, allowing the nail head to pass. As the nail head passes the middle of leaf spring 67, leaf spring 67 relaxes to its natural position, holding the nail within cavity 61. With its head against the bottom of cavity 61, the point of the nail protrudes approximately one-quarter inch (¼") beyond frond end 16. The user can press the tip of the nail into the nailing surface. The stiffness of leaf spring 67 is calculated to allow the nail to slide out of cavity 61 when apparatus 10 is drawn away from the nailing surface. At this point, the nail has been set for the user to drive without the user being forced to negotiate any obstacles or start the nail by hand.

In a second embodiment of the present invention, the nail is held into nail holder 55 by a magnet instead of leaf spring 67. The magnet is fastened to the base of cavity 61, holding a nail within nail holder 55.

Figure 4B:
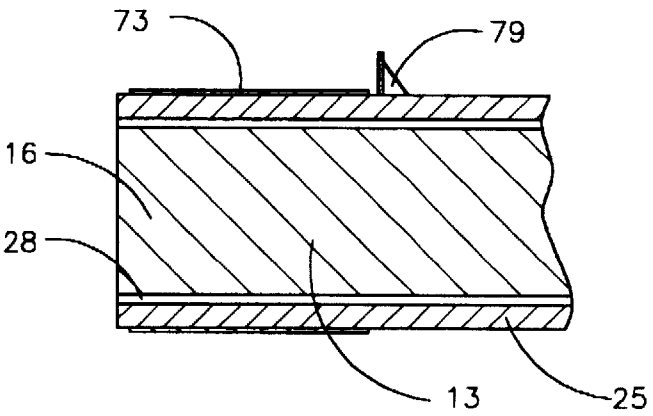
FIGS. 4*a* and 4*b* are an end view and a side elevation view, respectively, of the front end of an alternate embodiment of the present invention.
Figure 4A:
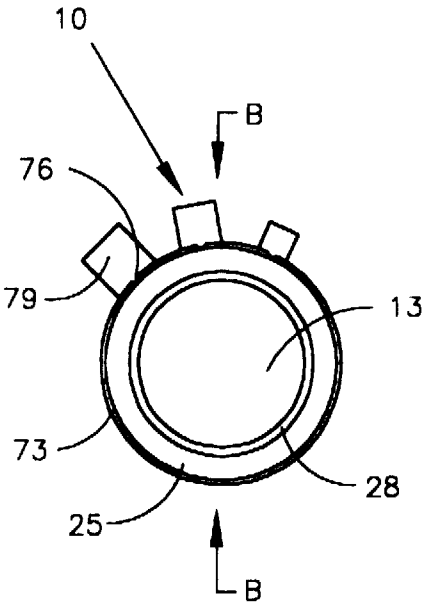

FIGS. 4*a* and 4*b* show a third embodiment of the present invention. In this embodiment nail holder 55 comprises a magnetic second sleeve 73 that rigidly engages the terminal end of tube 25 corresponding to front end 16. Second sleeve 73 is approximately three-quarters of an inch ("¾") in length and comprises a plurality of longitudinal third grooves 76 with arcuate cross-sections. Second sleeve 73 is polarized to magnetically hold a steel nail within third groove 76. A partial flange section 79 slightly wider than the head of a nail is rigidly mounted to the outside surface of tube 25 at a point collinear with each third groove 76. Each flange section 79 is mounted at a point along tube 25 designed to allow a nail to extend approximately one-quarter inch ("¼") beyond the terminal point of tube 25. Numerous flange sections 79 can be attached to tube 25 corresponding with nails of differing lengths.

Although a limited number of embodiments of the invention have been illustrated and described, various alternatives, modifications and equivalents may be used. Therefore, the foregoing description should not be taken as limiting the scope of the inventions which are defined by the appended claims.

What is claimed is:

1. A nail driving apparatus comprising:

a tube having a bore along its entire length;

a rod having a front end and a back end, said rod being slightly longer than said tube and slidably mounted in said bore for reciprocating movement therein whereby said front end engages the head of a nail placed within said bore;

a mass rigidly attached to said back end, said mass having a first neck being substantially cylindrical and adjacent said back end;

a collar rigidly mounted to the external surface of said tube, said collar having a second neck being substantially cylindrical and positioned nearest said back end; and a spring permanently engaging said first neck and said second neck whereby said mass is normally urged toward said tube.

2. An apparatus according to claim 1 wherein said tube and said rod have substantially circular cross-sections.

3. An apparatus according to claim 1 wherein said front end is adapted to abut against the head of a nail.

4. An apparatus according to claim 1 wherein said mass is substantially cylindrical.

5. An apparatus according to claim 1 wherein the external surface of said mass is coated with a friction enhancing substance.

6. An apparatus according to claim 1 wherein the external surface of said mass is machined to increase said surface's coefficient of friction.

7. An apparatus according to claim 1 wherein said collar is rigidly attached to said tube with a set screw whereby the positioning of said collar with respect to said tube is variable.

8. An apparatus according to claim 1 wherein said spring is helical in shape and encircles said tube and said rod.

9. An apparatus according to claim 1 wherein said spring is a rubber band.

10. An apparatus according to claim 1 further comprising a flexible first sleeve encircling said spring, said first sleeve being attached between said mass and said collar and being approximately as long as said rod whereby said sleeve encircles the exposed portion of said rod as said weight is drawn away from said tube.

11. An apparatus according to claim 1 further comprising a nail holder, said nail holder comprising:

a body having a cylindrical cavity therein to receive a nail, said body being positioned along the external surface of said tube such that, when a nail is inserted completely into said cavity, a portion of said nail protrudes beyond the terminal point of said front end; and a means for releasably engaging said nail within said cavity whereby insertion of the tip of said nail into a nailing surface will hold the nail with sufficient resistance to allow said apparatus to be drawn away from said nailing surface, leaving said nail in a position to be driven into the nailing surface.

12. A nail driving apparatus comprising:

a tube having a bore along its entire length;

a rod having a front end adapted to abut the head of a nail and a back end, said rod being slightly longer than said tube and slidably mounted in said bore for reciprocating movement therein whereby said front end engages the head of a nail placed within said bore;

a mass rigidly attached to said back end, said mass having a first neck being substantially cylindrical and adjacent said back end;

a collar rigidly mounted to the external surface of said tube, said collar having a second neck being substantially cylindrical and positioned nearest said back end;

a spring permanently engaging said first neck and second neck whereby said mass is normally urged toward said tube; and a flexible first sleeve encircling said spring, said first sleeve permanently engaging said mass and said collar and being approximately as long as said rod whereby said sleeve encircles the exposed portion of said rod as said weight is drawn away from said tube.

13. An apparatus according to claim 13 wherein said tube and said rod have substantially circular cross-sections.

14. An apparatus according to claim 14 further comprising a nail holder, said nail holder comprising:

a body having a cylindrical cavity therein to receive a nail, said body being positioned along the external surface of said tube such that, when a nail is inserted completely into said cavity, a portion of said nail protrudes beyond the terminal point of said front end; and a means for releasably engaging said nail within said cavity whereby insertion of the tip of said nail into a nailing surface will hold the nail with sufficient resistance to allow said apparatus to be drawn away from said nailing surface, leaving said nail in a position to be driven into the nailing surface.

15. An apparatus according to claim 13 wherein said mass is substantially cylindrical.

16. An apparatus according to claim 13 wherein the external surface of said mass is coated with a friction enhancing substance.

17. An apparatus according to claim 13 wherein the external surface of said mass is machined to increase said surface's coefficient of friction.

18. An apparatus according to claim 13 wherein said collar is rigidly attached to said tube with a set screw whereby the positioning of said collar with respect to said tube is variable.

19. An apparatus according to claim 13 wherein said spring is helical in shape and encircles said tube and said rod.

20. An apparatus according to claim 13 wherein said spring is a rubber band.

21. A nail driving apparatus comprising:

a hollow, cylindrical tube having a bore along its entire length;

a cylindrical rod having a front end adapted to abut the head of a nail and a back end, said rod being slightly longer than said tube and slidably mounted in said bore for reciprocating movement therein whereby said front end engages the head of a nail placed within said bore;

a cylindrical mass rigidly attached to said back end, said mass having a first neck being substantially cylindrical and adjacent said back end;

a friction increasing means covering substantially all of the external surface of said mass;

a collar rigidly mounted to the external surface of said tube, said collar having a second neck being substantially cylindrical and positioned nearest said back end;

a helical spring permanently engaging said first neck and second neck and encircling said tube and said rod whereby said mass is normally urged toward said tube;

a sleeve encircling said spring, said sleeve being permanently engaged to said mass and said collar and being approximately as long as said rod whereby said sleeve will encircle the exposed portion of said rod as said weight is drawn away from said tube;

a nail holder having a body with a cylindrical cavity therein to receive a nail, said body being positioned along the external surface of said tube such that, when a nail is inserted completely into said cavity, a portion of said nail protrudes beyond the terminal point of said front end; and a means for releasably engaging said nail within said cavity whereby insertion of the tip of said nail into a nailing surface will hold the nail with sufficient resistance to allow said apparatus to be drawn away from said nailing surface, leaving said nail in a position to be driven into the nailing surface.

* * * * *